United States Patent [19]

Ekkert

[11] Patent Number: 4,773,550

[45] Date of Patent: Sep. 27, 1988

[54] SAFETY CLOSURE FOR CONTAINERS

[76] Inventor: Leonard Ekkert, 735 Ledo St., Lemont, Ill. 60439

[21] Appl. No.: 119,862

[22] Filed: Nov. 13, 1987

[51] Int. Cl.[4] ..... B65D 55/02; A61H 1/00

[52] U.S. Cl. ..... 215/206; 215/235; 215/211; 215/237; 222/153

[58] Field of Search ..... 215/206, 209, 211, 235, 215/237; 222/153

[56] References Cited

U.S. PATENT DOCUMENTS 4,629,081 12/1986 McLaren ..... 215/206

4,723,669 2/1988 Barriac ..... 215/206

*Primary Examiner*—George T. Hall

*Attorney, Agent, or Firm*—Ernest Kettelson

[57] ABSTRACT

A safety closure for a container having a tubular neck surrounding a passageway having an outlet aperture for pouring contents from the container, the safety closure comprising a cap in the form of an inverted cup having an outer peripheral wall and an inner peripheral wall concentric with the outer peripheral wall spaced apart inwardly a short distance radially of about an eighth of an inch. A closure wall extends across the top having a closure tab hinged at one end for pivotal movement between an open and closed position. When in the closed position it closes an aperture opening to a central cavity bounded by the inner peripheral wall, the central cavity in turn opening to the open bottom wall of the closure cap for communication with the chamber of the container when the closure cap is in place thereon. The free end of the closure tab terminates at the peripheral edge of the outer peripheral wall and seats in a cut out portion thereof when in the closed position. A deflectable barrier strip is formed in the outer peripheral wall immediately below the cut out portion, the free end of the closure tab in the closed position abutting against the upper edge of the deflectable barrier strip forming a lateral crack therebetween. The outer portion of the upper edge of the barrier strip includes an upwardly extending flexible nib therealong which covers that crack and prevents inserting anything therein to pry up the free end of the closure tab. In order to gain access to the free end of the closure tab for opening, the deflectable barrier strip has to be pressed inwardly whereupon a portion of the closure tab is bared for pushing upwardly to the open position.

14 Claims, 10 Drawing Sheets

SAFETY CLOSURE FOR CONTAINERS

BACKGROUND OF THE INVENTION

This invention relates to the field of safety closures for containers, in which the closure includes a mechanism or structure that makes opening difficult enough that small children in particular cannot normally open containers having materials that would be harmful or dangerous, or that they should otherwise not be able to open.

A variety of such closure caps are known to the prior art which attempt to solve the problem in different ways, and a number of U.S. patents have been issued for such prior art closure caps including the following: U.S. Pat. Nos.

4,625,898, 4,377,247, 4,282,991, 4,220,248, 4,219,138, 4,209,114, 4,172,540, 4,124,151, 4,081,113, 4,047,643, 3,977,557, 3,967,764, 3,957,181, 3,893,593, 3,884,394, 3,881,643, 3,877,598, 3,874,568, 4,209,100, 3,873,005, 3,863,818, 3,860,137, 3,851,805, 3,784,060, 3,777,936, 3,774,808, 3,718,238, 3,655,103, 3,848,780, 3,844,455, 3,765,578, 4,635,823, 4,298,129, 4,281,778, 3,927,805, 4,298,129, 3,826,394, 4,220,262.

The safety closure cap in accordance with this invention provides a novel structure to achieve the safety objective. An outer continuous peripheral wall or skirt of the safety cap is spaced radially outwardly from an inner concentric peripheral wall which seats in the neck of the container to seal it closed. The continuous outer wall is integrally formed with the top closure wall of the cap and depends therefrom giving structural stability and strength to a deflectable barrier strip integrally formed therein which bars access to a hinged closure tab provided on the top closure wall until the barrier strip is deflected inwardly. A thin laterally extending web or nib extends upwardly from the outer portion of the upper edge of the deflectable barrier strip to cover the crack between the free end of the closure tab resting on and abutting against the upper edge of the deflectable barrier strip. Thus, a child for example cannot get his fingernail, or a knife, or other thin item into this crack to pry up the free end of the closure tab. The only way to gain access to an underportion of the closure tab to push it upwardly to the open position is by first pushing in on the deflectable barrier strip to expose an underportion of the closure tab. The closure tab has an elongated cylindrical plug extending downwardly from its inwardly facing surface to frictionally seat in a corresponding cylindrical recess positioned below the closure tab in the top closure wall, thereby closing the apertures in the bottom of the cylindrical recess and sealing against leakage of the contents from the container on which the closure cap is seated.

SUMMARY OF THE INVENTION

It is an object of the invention to provide a safety closure cap for a container having a neck on which the safety closure cap is received, wherein the cap is not removable from the container once it has been received thereon and a closure tab on the cap is not openable until a protective barrier is deflected to provide access to the closure tab for opening.

It is an object of the invention to provide a safety closure cap for a container having a neck on which the safety closure cap is received, wherein the cap includes a closure tab connected for pivotal movement between an open and a closed position and a deflectable barrier strip to prevent access to said closure tab until said barrier strip is deflected.

DESCRIPTION OF PREFERRED EMBODIMENT

Figure 1:
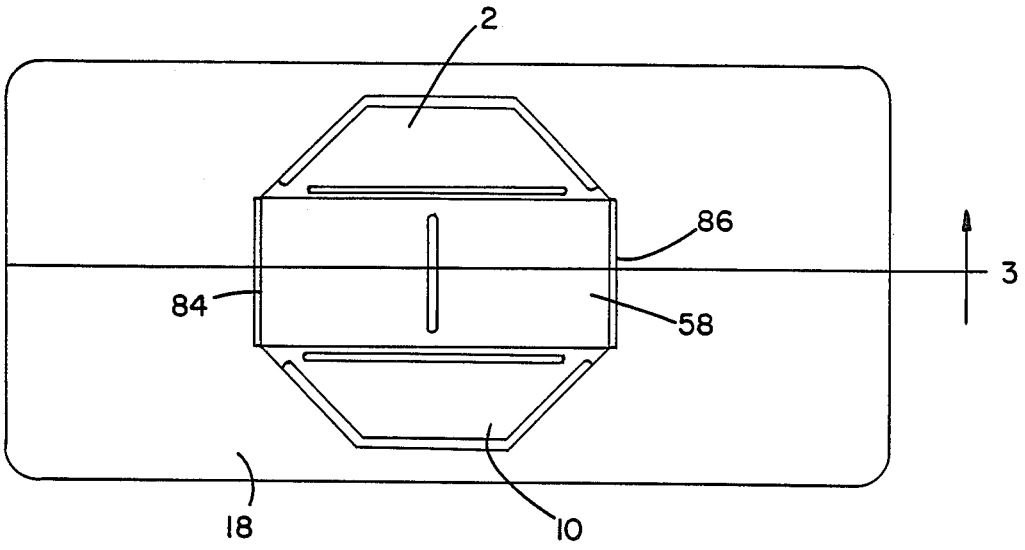
FIG. 1 is a top plan view of a container having a safety closure in accordance with this invention in place thereon.
Figure 2:
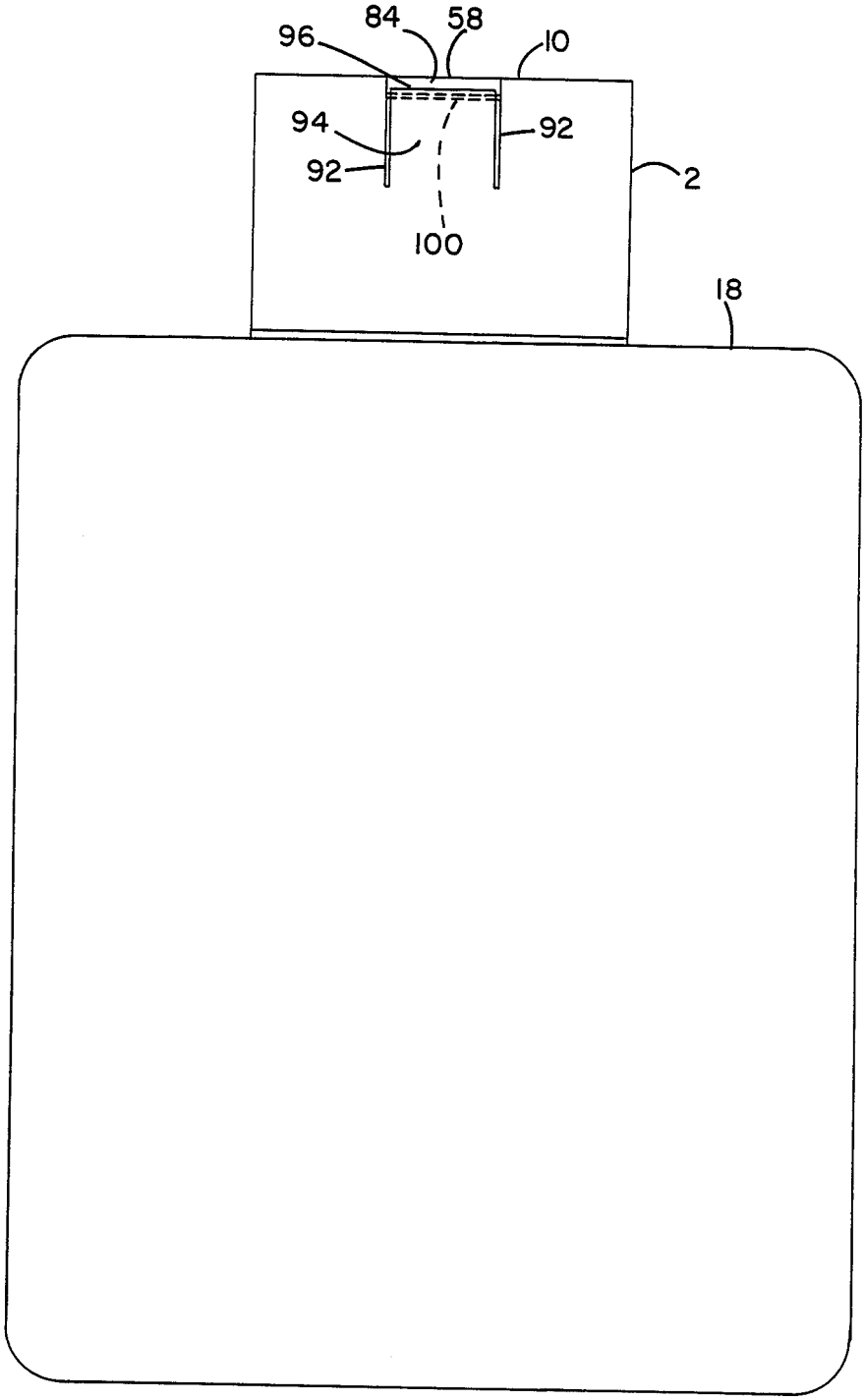
FIG. 2 is a side elevation of the container with safety closure thereon as showing in FIG. 1.
Figure 3:
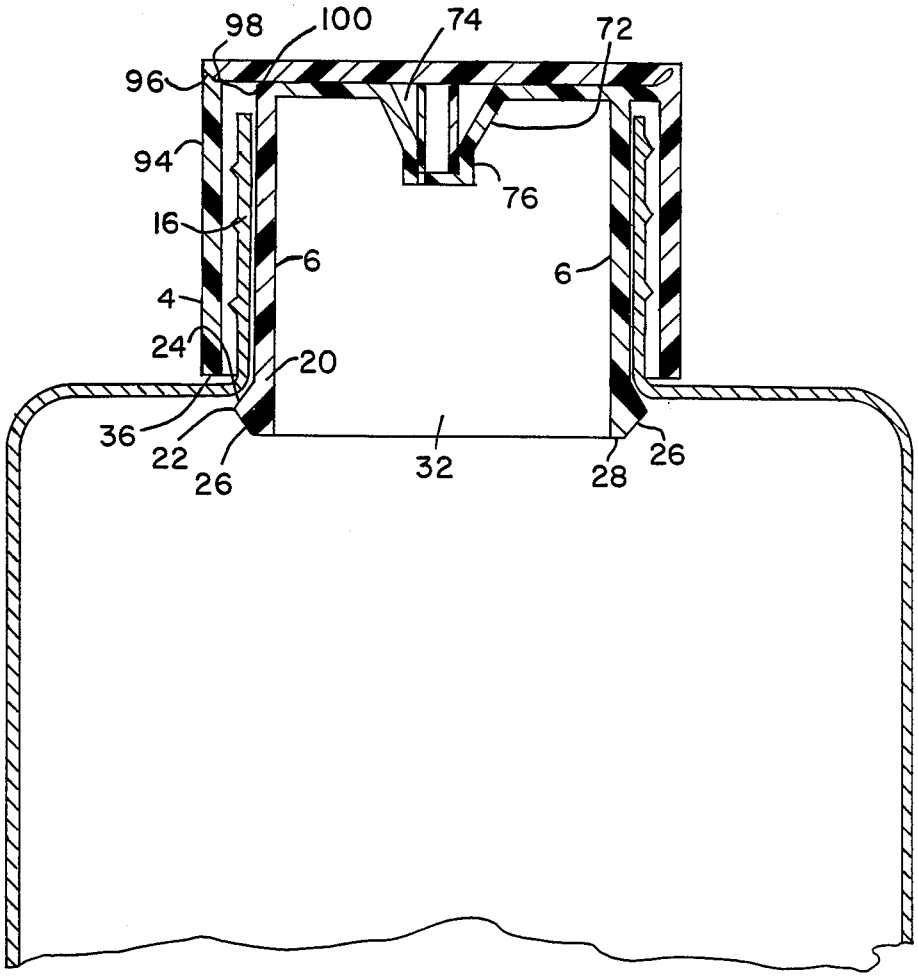
FIG. 3 is a section view taken on line 3—3 of FIG. 1.
Figure 4:
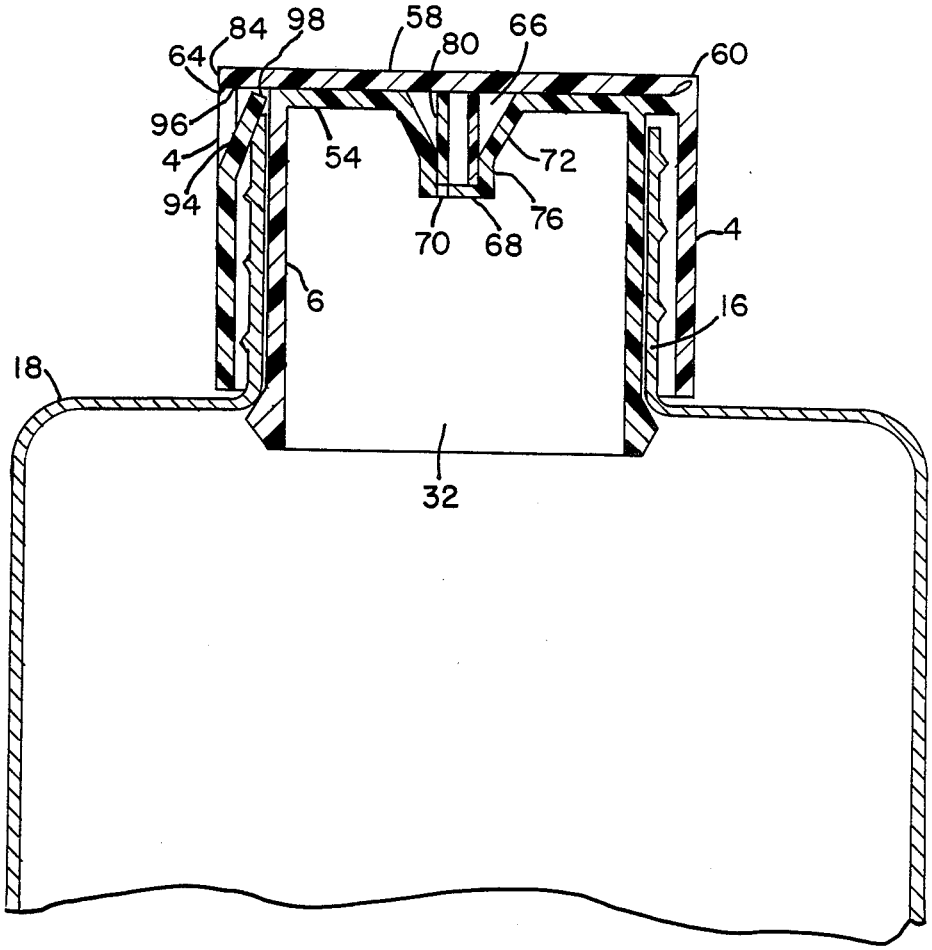
FIG. 4 is a section view as in FIG. 3 but with the deflectable barrier strip portion of this invention shown deflected inwardly to expose an end portion of the lower surface of the closure tab.
Figure 5:
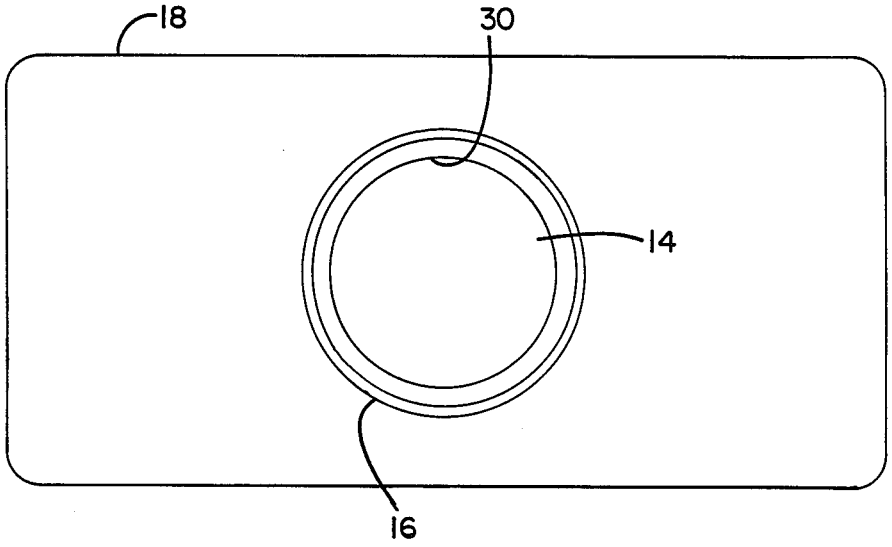
FIG. 5 is a top plan view of the container shown in FIG. 1 with the safety closure removed.
Figure 6:
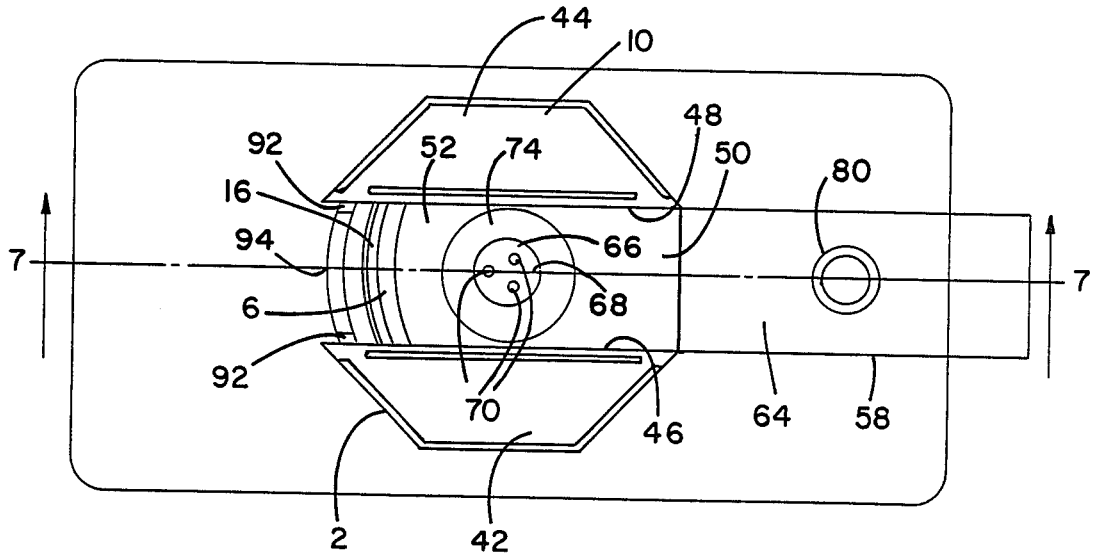
FIG. 6 is a top plan view of the container and safety closure shown in FIG. 1 but with the closure tab in the open position.
Figure 7:
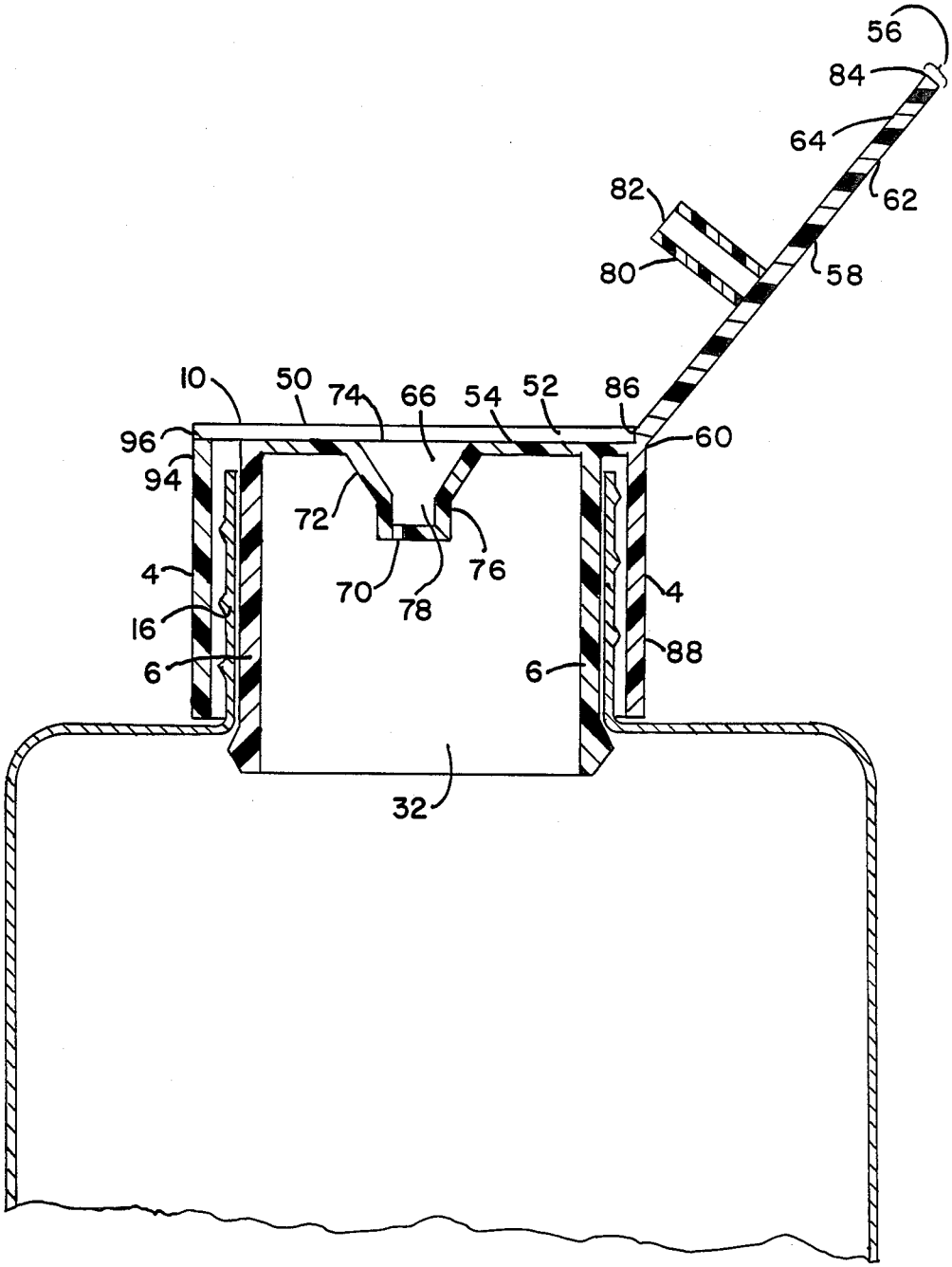
FIG. 7 is a section view taken on line 7—7 of FIG. 6.
Figure 8:
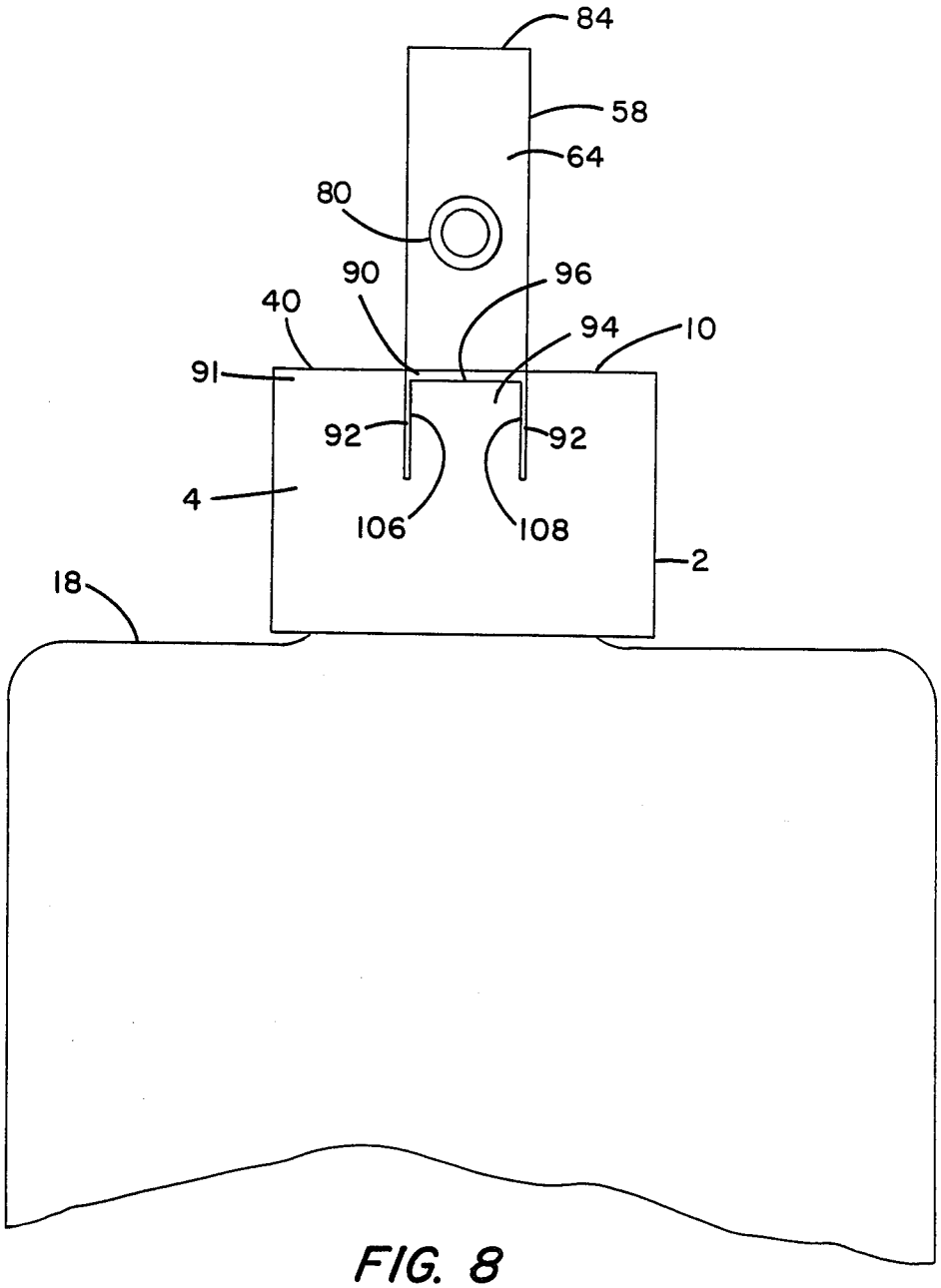
FIG. 8 is a side elevation view of the container with safety closure thereon and closure tab open as shown in FIG. 6.
Figure 9:
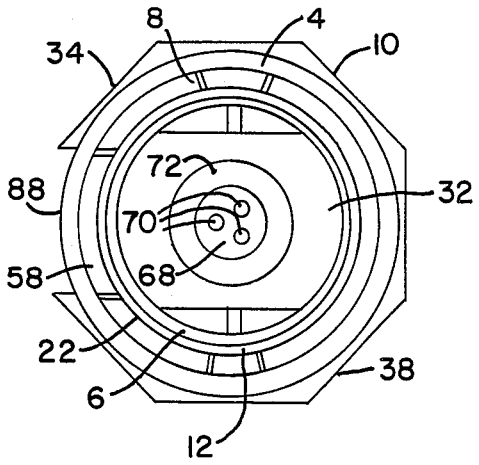
FIG. 9 is a bottom plan view of the safety closure in accordance with this invention.
Figure 10:
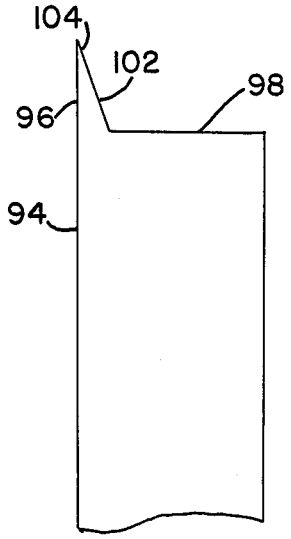
FIG. 10 is an enlarged side elevation view of a fragment of the deflectable barrier strip portion of this invention to more clearly show the detail structure of the laterally extending web which conceals the crack between the lower surface of the closure tab and upper edge of the deflectable barrier strip when the closure tab is in the closed position.
Figure 11:
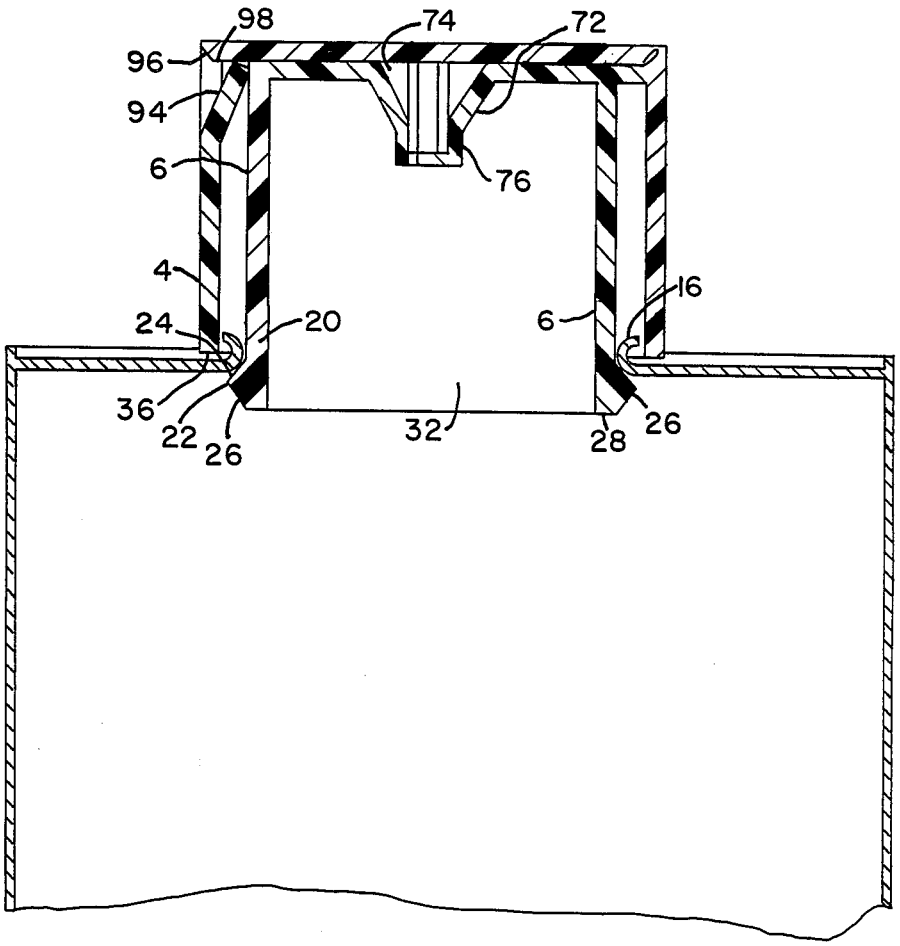
FIG. 11 is a section view similar to that of FIG. 4, but showing a metal can having a different kind of neck with which the safety closure in accordance with this invention may also be used, namely a short neck having an annular flange of C-shape cross-section rather than an elongated neck having threads.

A safety closure for containers in accordance with this invention comprises a cap 2 in the form of an inverted cup having an outer peripheral annular wall 4 and an inner peripheral annular wall 6 concentric with the outer annular wall 4 and spaced apart inwardly therefrom a short distance on the order of a sixteenth to an eighth of an inch. The concentric annular walls 4 and 6 terminate at their upper ends at the inwardly facing surface 8 of the top wall 10 which extends across the cap 2 in a direction substantially normal to the concentric annular walls 4 and 6. The annular walls 4 and 6 are relatively rigid but of a material that is pliable enough to permit flexing under pressure.

The inner annular wall 6 terminates at its lower end in an enlarged annular retaining rim 12 to seat within the opening 14 of the neck 16 of a container 18 on which the safety closure cap 2 is to be used. The annular retaining rim 12 includes an outwardly extending annular projection 20 having a triangular cross-section comprising an annular apex 22, a sloping upper annular wall portion 24 sloping inwardly from the annular apex 22 in the direction toward the top wall 10, and a tapering lower annular wall portion 26 tapering inwardly from the annular apex 22 in the opposite direction downwardly terminating at the lower edge 28 of the inner annular wall 6.

When the cap 2 is placed on the neck 16 of a container 18, the tapering lower annular wall portion 26 is received within the neck opening 14 and in contact with its annular edge 30. As the cap 2 is pressed downwardly, the tapering lower annular wall portion 26 in contact with the annular edge 30 of the neck opening 14 deflects the annular retaining rim 12 of the inner annular wall 6 until its annular apex 22 is able to pass the annular edge 30 of the neck opening 14 whereupon it expands back toward its original position thereby preventing withdrawal of the inner annular wall 6 and the cap 2 from the neck 16 of the container 18.

The inner annular wall 6 surrounds a central cavity 32 of the cap 2, opening inwardly to the chamber 34 of the container 18 when the cap 2 is placed thereon.

The outer annular wall 4 extends downwardly from the outer peripheral edge 34 of the top wall 10, and its lower end 36 terminates at a point spaced apart upwardly from the annular apex 22 of the annular retaining rim 12 of the inner annular wall 6.

The top wall 10 of the cap 2 has a substantially annular peripheral edge 38 and a substantially planar upper surface 40 extending in a direction substantially normal to the concentric annular walls 4 and 6. The top wall 10 comprises two spaced apart segments 42 and 44, segment 42 bounded by a straight edge or chord 46 and segment 44 bounded by a straight edge or chord 48 which is spaced apart from and substantially parallel to chord 46, each cord being spaced apart equidistantly in opposite directions from the diameter of the substantially annular top wall 10 which is parallel to chords 46 and 48.

The spaced apart segments 42 and 44 and their respective straight edges or chords 46 and 48 define a substantially rectangular opening 50 to a substantially rectangular recess 52 having a floor 54 spaced apart inwardly of and downwardly from the upper surface 40 of the top wall 10 a short distance substantially equal to the thickness 56 of a closure tab 58 having a substantially rectangular peripheral configuration and dimension corresponding to that of the rectangular opening 50. The closure tab 58 is connected by an integrally formed hinge 60 integrally connected to and extending from the upper end of the outer annular wall 4 in registration with the rectangular opening 50 whereby closure tab 58 is connected for pivotal movement between an open and closed position. In the closed position, the closure tab 58 seats completely within the opening 50 and rectangular recess 52 with its upper surface 62 coplanar with the planar upper surface 40 of top wall 10 of the cap 2, and with its lower surface 64 resting against the floor 54 of the recess 52.

A circular sub-recess or well 66 extends downward from the central portion of the recess 52 opening to the floor 54 thereof and having a circular bottom wall 68 through which three apertures 70 are formed opening to the central cavity 32 of the cap 2 which is bounded by the inner annular wall 6. The sub-recess or well 66 has a frusto-conical wall portion 72 extending downwardly from its relatively large diameter opening 74 to the recess 52, converging inwardly and terminating at an integrally joined cylindrical wall portion 76 having a cylindrical cavity 78 of relatively smaller diameter than the large diameter opening 74. The cylindrical wall portion 76 extends downwardly from its junction with the lower edge of the integrally joined frusto-conical wall portion 72 for a relatively short distance of about a sixteenth of an inch or thereabouts, to terminate at the circular bottom wall 68 which is integrally joined to the lower edge of the cylindrical wall portion 76.

A cylindrical plug 80 extends from the central portion of the lower surface of the closure tab 58, positioned for registration with and seating in the cylindrical cavity 78 of the sub-recess or well 66 when closure tab 58 is pivoted to its closed position. The cylindrical plug 80 has a longitudinal dimension corresponding to the distance between the bottom wall 68 of the sub-recess or well 66 and its large diameter opening 74 to recess 52, whereby when closure tab 58 is in its closed position the free end 82 of cylindrical plug 80 extends to and abuts against the bottom wall 68 to close the three apertures 70. The peripheral configuration and dimension of the cylindrical plug 80 corresponds to that of the cylindrical cavity 78 for a tight sealing fit when received therein.

When the closure tab 58 is in its closed position with cylindrical plug 80 tightly seated in the cylindrical cavity 78 with its free end 82 abutting against the bottom wall 68 of the sub-recess or well 66, the contents of a container 18 on which the closure cap 2 is in place are effectively sealed within the container 18 and prevented from leaking out. When it is desired to pour the contents from the container 18, the closure tab 58 must be pivoted upwardly to the open position, whereupon the contents may be poured out through the apertures 70 in the bottom wall 68 of the sub-recess or well 66.

The closure tab 58 has a safety feature to prevent opening by a child or to make it difficult enough to meet a particular standard of difficulty for a child to move the closure tab 58 from the closed position to the open position. This safety feature is described as follows.

The free end 84 of the rectangular closure tab 58, opposite from the integrally hinged end 86, terminates at a point which when in the closed position is substantially in line with that part of the outer surface 88 of the outer annular wall 4 which lies immediately below the free end 84 of closure tab 58. An upper edge cut-away portion 90 is provided across that portion of the upper end 91 of the outer annular wall 4 which faces the rectangular recess 52 and the free end 84 of closure tab 58 when seated therein, the width of such cut-away portion 90 corresponding substantially to the width across free end 84 of tab 58, the depth of the cut-away portion 90 corresponding substantially to the thickness of the closure tab 58.

A pair of spaced apart substantially parallel cuts 92 extend downwardly in the outer annular wall 4 from each opposite side of the cut-away portion 90 to form therebetween an inwardly deflectable barrier strip 94 which prevents access to the lower surface 64 of the closure tab 58 at its free end 84 until deflected inwardly in the direction toward the inner annular wall 6 a sufficient distance to bare a portion of the lower surface 64 of tab 58 at its free end 84. A person can push the deflectable barrier strip 94 inwardly with his thumb, and at the same time use his thumb to then push upwardly on the edge of the closure tab 58 when a portion of its lower surface 64 is bared and in facing relationship to the thumb.

A laterally extending finger nail prevent nib 96 is formed along the upper edge 98 of the deflectable barrier strip 94 to conceal the crack 100 between the free end 84 of tab 58 and the upper edge 98 of barrier strip 94 against which it abuts when tab 58 is in the closed position. This laterally extending nib 96 prevents a child or other person from extending his fingernail or other thin prying device into the crack 100 and prying the free end 84 of closure tab 58 upwardly enough to force it from the closed to open position. The nib 96 is a very thin upward extension of that part of the outer annular wall 4 between the parallel cuts 92 which forms the deflectable barrier strip 94 integrally connected thereto. The nib 96 extends laterally across the entire width of the upper edge 98 of barrier strip 94, which width corresponds to that of the free end 84 of the closure tab 58. The nib 96 extends upwardly from the upper edge 98 of barrier strip 94 a very short distance such as one-sixteenth of an inch or thereabout, just sufficient to cover and conceal the crack 100. The nib 96 extends inwardly from the outer surface 88 of barrier strip 94 along its upper edge 98 a very short distance along its integral connection to the upper edge 98 of barrier strip 94, the inwardly facing surface 102 of the nib 96 then tapering along a diagonal line which converges toward the outer surface 88 as it extends upwardly to terminate at the upper free edge 104 of the laterally extending nib 96. This laterally extending nib 96 is freely deflectable outwardly as it bears and slides against the facing surfaces of the closure tab 58 when the inwardly deflectable barrier strip 94 is pushed upwardly enough to gain access to a free end portion of the lower surface 64 of the closure tab 58 for pushing upwardly to the open position.

The length of the parallel cuts 92 which border the opposite side edges of the inwardly deflectable barrier strip 94 are such that the longitudinal dimension of the side edges 106 and 108 thereof are preferably shorter than the lateral dimension across the barrier strip 94 between the side edges 106 and 108. The lower the ratio of the longitudinal dimension to the lateral dimension of the integrally formed barrier strip 94, the less flexible and less easily deflectable will such barrier strip be. The higher that ratio is, the more flexible and more easily deflectable. These dimensions can be selected to provide whatever ratio and whatever degree of difficulty is desired to deflect the barrier strip 94 inwardly to begin the first step of gaining access to the closure tab 58 for opening.

To open the closure tab 58 for pouring contents from the container 18, a person must first press inwardly on the deflectable barrier strip 94 with sufficient force to bare a portion of the lower surface 64 of the closure tab 58 at its free end 84, then press upwardly on such free end portion of the closure tab 58 with sufficient force to draw the free end 82 of the cylindrical plug 80 out of the cylindrical cavity 78 of the sub-recess or well 66 in the top wall 10, in which it is seated and frictionally held to seal the contents of the container from leaking out.

When pressure is released from the deflectable barrier strip 94 it flexes back to its original position wherein its outer surface is again in arcuate alignment with the outer surface 88 of the outer annular wall 4. Access to the free end 54 of clsour tab 58 for opening it is thereby barred automatically when the closure tab 58 is pivoted back to its closed position with the lower surface 64 of its free end 84 abutting against the upwardly facing free end 98 of the deflectable barrier strip 94 and with the laterally extending nib or web 96 concealing the crack 100 therebetween. The free end 82 of cylindrical plug 80 seats tightly in the cylindrical cavity 78 of sub-recess 66 to securely hold the closure tab 58 in the closed position until the opening procedure described above in again performed.

I claim:

1. A safety closure for a container having a neck surrounding a passageway having an outlet aperture for pouring contents from the container, said safety closure comprising peripheral wall means surrounding a tubular cavity and extending from an open first end thereof to a closeable second end, closure wall means across said closeable second end, said closure wall means including an aperture opening to said tubular cavity of said safety closure, an openable closure member movable between an open and a closed position in registration with said aperture to seal it closed when said openable closure member is in said closed position, and deflectable barrier means to bar operable opening access to said openable closure member when it is in its said closed position until said deflectable barrier means is deflected to provide opening access thereto.

2. A safety closure as set forth in claim 1, wherein said peripheral wall means includes an outer annular wall having an inner and outer surface, said deflectable barrier means being positioned on said outer annular wall in registration with said openable closure member to bar openable access thereto when it is in its said closed position until said deflectable barrier means is deflected to provide operable opening access thereto.

3. A safety closure as set forth in claim 2, wherein said deflectable barrier means includes a deflectable barrier strip having a pair of opposite substantially parallel sides extending longitudinally of said strip a first longitudinal dimension, said sides being spaced apart a distance corresponding to a second lateral dimension across said strip, said deflectable barrier strip having an upwardly facing free end facing in the direction toward said closeable second end and said closure wall means thereacross, said deflectable barrier strip having an opposite end integrally formed with said outer annular wall, said openable closure member having a free end terminating at a point substantially in line with said outer surface of said outer annular wall and of said defelectable barrier strip integrally formed therewith when said openable closure member is in its said closed position, said openable closure member at such time abutting against said upwardly facing free end of said deflectable barrier strip along a thin crack therebetween.

4. A safety closure as set forth in claim 3, wherein said deflectable barrier strip includes a thin concealment strip extending laterally across said upwardly facing free end thereof to conceal and prevent access to said crack between said upwardly facing free end of said deflectable barrier strip and said free end of said openable closure member abutting thereagainst when in its said closed position, said thin concealment strip having an outer surface and an inner surface, said outer surface of said thin concealment strip being in line with said outer surface of said outer annular wall, said inner surface of said thin concealment strip tapering along a diagonal line extending from the upper free end of said thin concealment strip and diverging from said outer surface thereof as it extends in the direction downwardly toward said upwardly facing free end of said deflectable barrier strip, said inner surface of said thin concealment strip terminating at its lower end at said upwardly facing free end of said deflectable barrier strip at a point thereon spaced apart from said inner surface thereof and of said outer annular wall in the direction toward said outer surface thereof leaving space for said free end of said openable closure member to seat on and abut against the remaining portion of said upwardly facing free end of said deflectable barrier strip.

5. A safety closure as set forth in claim 2, wherein said peripheral wall means includes an inner annular wall spaced apart inwardly a short distance from said outer annular wall and coaxial therewith, said inner annular wall extending farther from said closeable second end and said closure wall means thereacross than said outer annular wall by a predetermined distance.

6. A safety closure as set forth in claim 2, wherein said closure wall means comprises a closure wall having a peripheral edge encompassing a pair of spaced apart segments each having spaced apart parallel straight edges, said segments each having a planar upper surface, each being coplanar, a recess between said straight edges of said spaced apart segments, said openable closure member having a peripheral configuration and dimension corresponding to that of said recess, said recess having a substantially planar floor spaced apart inwardly a preselected distance from said coplanar upper surfaces of said segments in the direction toward said first open end of said peripheral wall means, said openable closure member having a thickness substantially equal to said preselected distance, said openable closure member having a substantially planar upper surface and a substantially planar lower surface, said substantially planar upper surface thereof being substantially coplanar with said upper surfaces of said segments when said openable closure member is in its said closed position at which time its said substantially planar lower surface is in abutting relationship with said floor of said recess, said openable closure member having a first end pivotally connected to said closure wall and a second free end in registration with said deflectable barrier means of said outer annular wall, said openable closure member closing said aperture when in said closed position.

7. A safety closure as set forth in claim 6, wherein said closure wall means includes a sub-recess opening to said substantially planar floor of said recess, said sub-recess having peripheral wall means extending downwardly from said floor of said recess terminating at a bottom wall of said sub-recess, including said bottom wall of said sub-recess, said aperture of said closure wall means being formed in and through said bottom wall of said sub-recess for open communication between said sub-recess and said tubular cavity of said safety closure, said openable closure member including an elongated sealing member extending from its said lower surface located at a point thereon which is in registration with said sub-recess when said openable closure member is in its said closed position to seat therein and sealingly close said aperture in said bottom wall of said sub-recess.

8. A safety closure as set forth in claim 7, wherein said peripheral wall means of said sub-recess includes a cylindrical wall portion bounding a cylindrical cavity portion of said sub-recess, said elongated sealing member of said openable closure member having a cylindrical stem portion to seat in said cylindrical cavity portion of said sub-recess when said openable closure member is in its said closed position, said cylindrical stem portion of said elongated sealing member having a diameter corresponding to that of said cylindrical cavity portion of said sub-recess to form a tight frictional seal therewith when seated therein.

9. A safety closure as set forth in claim 8, wherein said peripheral wall means of said sub-recess includes a frusto-conical wall portion extending downwardly from said opening of said sub-recess to said floor of said recess and narrowing to said cylindrical wall portion.

10. A safety closure as set forth in claim 7, wherein said bottom wall of said sub-recess includes a plurality of apertures, including at least one additional aperture therein and therethrough.

11. A safety closure as set forth in claim 3, wherein said first longitudinal dimension of said sides of said deflectable barrier strip is less than said second lateral dimension across said deflectable barrier strip.

12. A safety closure as set forth in claim 3, wherein the force needed to flex said deflectable barrier strip inwardly decreases as the ratio of said first longitudinal dimension of its said sides to said second lateral dimension thereacross increases, said opposite sides of said deflectable barrier strip being separated from said peripheral wall means with which one end of said deflectable barrier strip is integrally formed by respective longitudinal cuts through said peripheral wall means extending downwardly from said upwardly facing free end of said deflectable barrier strip, the flexibility of said deflectable barrier strip being variable by varying the length of said longitudinal cuts.

13. A safety closure for a container having a neck surrounding a passageway having an outlet aperture for pouring contents from the container, said safety closure comprising peripheral wall means surrounding a tubular cavity and extending from an open first end thereof to a closeable second end, closure wall means across said closeable second end, said peripheral wall means including deflectable retaining means adjacent said open first end, said deflectable retaining means being receivable into said passageway surrounded by said neck of said container and deflectable by said outlet aperture thereof until said deflectable retaining means has passed through said outlet aperture to thereafter retain said safety closure on said neck of said container, said closure wall means including an aperture opening to said tubular cavity of said safety closure, an openable closure member movable between an open and a closed position in registration with said aperture to seal it closed when said openable closure member is in said closed position, and deflectable barrier means to bar operable opening access to said openable closure member when it is in its said closed position until said deflectable barrier means is deflected to provide opening access thereto.

14. A safety closure as set forth in claim 13, wherein said peripheral wall means includes an outer annular wall, an inner annular wall spaced apart inwardly a short distance from said outer annular wall and coaxial therewith, said inner annular wall extending farther from said closeable second end and said closure wall means thereacross than said outer annular wall by a predetermined distance, said deflectable retaining means adjacent said open first end being on said inner annular wall at its open first end, including said open first end of said inner annular wall.

* * * * *